US007690545B2

(12) United States Patent
Co

(10) Patent No.: US 7,690,545 B2
(45) Date of Patent: Apr. 6, 2010

(54) HAND-OPERATED STAPLER

(75) Inventor: Koc Sing Co, Kowloon (HK)

(73) Assignee: Cosimex (H.K.) Limited, Kowloon (HK)

( * ) Notice: Subject to any disclaimer, the term of this patent is extended or adjusted under 35 U.S.C. 154(b) by 155 days.

(21) Appl. No.: 12/141,102

(22) Filed: Jun. 18, 2008

(65) Prior Publication Data

US 2009/0314819 A1 Dec. 24, 2009

(51) Int. Cl.
*B25C 5/02* (2006.01)
*B25C 5/11* (2006.01)

(52) U.S. Cl. ..... 227/125; 227/127; 227/135

(58) Field of Classification Search ..... 227/119, 227/120, 121, 125, 126, 127, 135, 139
See application file for complete search history.

(56) References Cited

U.S. PATENT DOCUMENTS 4,133,468 A * 1/1979 Ewig ..... 227/126
4,607,777 A * 8/1986 Ebihara ..... 227/120
4,811,884 A * 3/1989 Sato ..... 227/83
4,927,067 A * 5/1990 Leszczak ..... 227/128
5,038,992 A * 8/1991 Shiang et al. ..... 227/120
6,299,047 B1 * 10/2001 Ghibely et al. ..... 227/134
7,124,924 B2 * 10/2006 Marks ..... 227/120
7,140,526 B2 * 11/2006 Matsukawa ..... 227/132
7,290,692 B2 * 11/2007 Marks ..... 227/8
7,431,186 B2 * 10/2008 Hsu ..... 227/120
7,455,206 B2 * 11/2008 Huang ..... 227/120
7,503,472 B2 * 3/2009 Marks ..... 227/120
7,513,406 B2 * 4/2009 Marks ..... 227/120
7,540,400 B2 * 6/2009 Zins et al. ..... 227/8
7,549,561 B2 * 6/2009 Kirby et al. ..... 227/120
7,614,537 B2 * 11/2009 Andersson et al. ..... 227/120
7,621,432 B2 * 11/2009 Chiang et al. ..... 227/120
2004/0040999 A1 * 3/2004 Ackeret ..... 227/63
2006/0151566 A1 * 7/2006 Ebihara ..... 227/134
2008/0149681 A1 * 6/2008 Marks ..... 227/119
2009/0050666 A1 * 2/2009 Jiang ..... 227/120
2009/0120992 A1 * 5/2009 Kandasamy ..... 227/120
2009/0272781 A1 * 11/2009 Maemori et al. ..... 227/120

* cited by examiner

*Primary Examiner*—Paul R Durand

(57) ABSTRACT

A hand-operated stapler comprises an arm, a sliding belt and a blocking member, wherein the arm comprises a front end which acts as an effort, a rear end which acts as a fulcrum, and a load portion in between the front end and the rear end of the arm; and the rear end of the blocking member is connected to a front end of the sliding belt. At a non-stapling default position a front end of the blocking member is biased to be disposed above the stopper and blocks the upper clincher member from engaging with the lower clincher member. At a stapling position the rear end of the sliding belt is pulled upward, thereby pulling the blocking member rearward and away from the stopper and thus allowing the upper clincher member to engage with the lower clincher member.

12 Claims, 13 Drawing Sheets

$$Fb*50=Fa*104$$
$$Fb=Fa*104/50$$
$$Fb*21=Fc*62$$
$$Fc=Fb*21/62=(Fa*104/50)*21/62=0.7*Fa$$

HAND-OPERATED STAPLER

BACKGROUND OF THE INVENTION

The present invention relates to a hand-operated stapler for stapling sheets of paper and more particularly pertains to a hand-operated stapler that requires exertion of less effort than a standard typical hand-operated stapler to bind multi-page documents by flat clinching and which is susceptible of a lower cost of manufacture with regard to materials than a standard typical hand-operated flat-clinch stapler.

Staplers are commonly found in offices, schools or other places that process large amounts of paper. There have been different improvements made to increase staplers' efficiency and effectiveness. Various power-operated staplers have been introduced to the market to save effort but they have electrical components and are thus more costly for production and purchase and more susceptible of being broken and irreparable. Hand-operated staplers are less expensive and more durable and are good for operations that do not require frequent stapling or stapling of thick documents. Repeated use of such a hand-operated stapler within a short period of time may easily cause muscle strain or even injury. Various improvements have been made to hand-operated staplers which mainly focus on making them requiring exertion of less effort and producing fewer incidents of squiggled clinches. However, existing hand-operated staplers remains to fall short of users' expectations.

Flat-clinch staplers have been getting popular in offices and schools. Unlike conventional staplers which do not flatten the staples completely, flat-clinch staplers completely flatten the ends of the staples making them fold up tight against the sheets of paper. FIGS. 1 to 3 illustrate a conventional flat-clinch stapler. To use the stapler, the user presses the front part of the pressing cap, thereby driving the metal head 7' downward. The crank 71' which connects the metal head 7' and the blocking member 12' is then driven to move the blocking member 12' backward, thereby allowing the lower clincher member 4' to move upward and eventually bend over the ends of the staple and flatten the ends, making them folding tight against the sheets of paper.

Flat clinching eliminates the crimps and curls of conventional stapling. This reduces the thickness of the paper stapled as the staple is totally flat and this allows neater stacking up of the paper documents with no protruding edges. This also avoids the sharp points or edges that can sometimes snag clothing, scratch other surfaces or even cause finger cuts. Despite the advantages of flat-clinch staplers over the conventional staplers, repeated use of the same may still cause muscle strain or injury. Further, the construction of a flat-clinch stapler is more complicated than a conventional stapler. As illustrated in FIGS. 1 to 3, the major parts for achieving the flat-clinching effect, i.e. the crank 71' and the blocking member 12', are made of metal and so flat-clinch staplers are susceptible of a higher manufacturing cost and accordingly a higher price of sale to the consuming public. Therefore, users are looking forward to hand-operated staplers which require exertion of less effort to make flat clinches and which is susceptible of lower prices of sale to the buying public.

BRIEF SUMMARY OF THE INVENTION

In view of the aforesaid disadvantages now present in the prior art, the object of the present invention is to provide a hand-operated stapler susceptible of a lower cost of manufacture that requires exertion of less effort to drive the staple through the sheets of paper to fasten the paper together and to bend over the two ends of the staple inward making it completely flat to clinch the paper.

To attain this, the present invention generally comprises a lower base, an upper base, an upper clincher member, a lower clincher member, a hanger, a magazine, a metal head and a pressing cap. The lower base is disposed with a receiving opening. The upper base slants down into the receiving opening at a stapling position. The upper clincher member is disposed at a front end of the upper base. The lower clincher member is fixedly disposed inside the receiving opening which achieves clinching effect when engaging with the upper clincher member. The hanger is welded to the upper base and disposed with a pin. The magazine has a rear end which is pivotable around the pin of the hanger. The metal head covers the magazine and has a rear end pivotable around the pin of the hanger. The pressing cap covers the metal head. The present invention further comprises an arm which is disposed in between the pressing cap and the metal head with a length shorter than that of the metal head. The arm comprises a front end which is securely connected to an anterior portion inside the pressing cap and acts as an effort, a rear end which is pivotable around an axis at a position between the metal head and the magazine and acts as a fulcrum, and a load portion in between the front end and the rear end of the arm which is securely connected to the pressing cap and drives the metal head to move downwards at the stapling position. The present invention further comprises a sliding belt, a stopper and a blocking member. The sliding belt has a rear end connected to a rear end of the pressing cap. The stopper is disposed inside the receiving opening. The blocking member is disposed inside the receiving opening of the lower base. A rear end of the blocking member is connected to a front end of the sliding belt. At a non-stapling default position a front end of the blocking member is biased to be disposed above the stopper and thereby blocks the upper clincher member from engaging with the lower clincher member. At the stapling position the rear end of the sliding belt is pulled upward by upward movement of the rear end of the pressing cap, thereby pulling the blocking member rearward and away from the stopper and thus allowing the upper base to slant down into the receiving opening and the upper clincher member to engage with the lower clincher member.

The sliding belt can be a plastic band or a leather strap.

The lower base further comprises a pulley disposed at its rear end, and the pulley is engaged with the sliding belt for ease of sliding of the sliding belt.

The blocking member is biased by a spring piece disposed underneath the blocking member inside the lower base to be disposed above the stopper at the non-stapling default position.

The blocking member comprises a first blocking piece and a second blocking piece which are slidably engaged with each other, and a rear end of the first blocking piece is connected to the front end of the sliding belt. At the non-stapling default position a front end of the first blocking piece is disposed to push the second blocking piece forward so as to maintain a front end of the second blocking piece at a position above the stopper. At the stapling position the front end of the first blocking piece is disposed to pull the second blocking piece backward and away from the stopper.

The lower clincher member is in the form of a vertical plate.

The upper clincher member comprises two pivotable flat slotting members disposed above the lower clincher member, and each of the flat slotting members has a top surface. At the stapling position the top surfaces of the two flat slotting members are pushed by the lower clincher member to form a substantially horizontal plane to bend over ends of a staple and flatten the ends making them fold up tight against sheets of paper. At the non-stapling default position the top surfaces of the two flat slotting members form a substantial V-shaped plane.

The arm is in the form of an elongated cover which partially covers the metal head and comprises a top plane and two lateral walls extended down from a left side and a right side of the top plane, and a hole is opened at the top plane for receiving a pressing block extended from the pressing cap, and the two lateral walls at the rear end of the arm is designed to rotate around two corresponding protrusions each being disposed on two external sides of the hanger. The ratio of an arm load distance to an arm effort distance is smaller than the ratio of a metal head load distance to a metal head effort distance; wherein the arm load distance is the distance between the fulcrum of the arm and the load portion of the arm; the arm effort distance is the distance between the fulcrum of the arm and the effort of the arm; the metal head load distance is the distance between the pin of the hanger and a front end of the metal head; and the metal head effort distance is the distance between the pin of the hanger and the load portion of the arm at the stapling position.

A protection cover is disposed to conceal the space in between the metal head and the magazine; the protection cover comprises a front side, a left side and a right side; and the left side and the right side of the protection cover are each pivotally connected to an internal surface of the pressing cap at a position at a rear end of the protection cover.

The left side and the right side of the protection cover each further comprises a hole opened at the rear end, and each of the two holes engages with a coil spring and one end of each coil spring is hooked onto an internal surface of the protection cover and the other end of each coil spring is hooked onto the internal surface of the pressing cap.

The magazine comprises a staple holder and a magazine cover which are slidably engaged with each other. Two lateral sides of the staple holder each has a first hooked arm at its rear end, and two lateral sides of the magazine cover each is disposed with a second hooked arm which is releasably engaged with the corresponding first hooked arm. A push button is disposed outside the pressing cap with its bottom end connected to the second hooked arms and engaging the second hooked arms with the first hooked arms at a closed default position, and at an opened position the push button is pushed and thereby driving the second hooked arms to disengage from the first hooked arms.

To use the present invention, the user inserts the sheets of paper to be stapled from the stapling end and then presses the front part of the pressing cap. The front end of the arm is pressed down, the rear end of the arm acts as a fulcrum and pivots around the protrusions disposed on two external sides of the hanger, and the pressing block presses the metal head to drive down the plunger blade to separate the front single staple from the row of staples. The protection cover also gradually retreats into the pressing cap. Simultaneously, when the front part of the pressing cap is pressed, the back end of the pressing cap is raised pulling the sliding belt upward and thus pulling the blocking member backward and away from the stopper. During the stapling process, the upper base will gradually slant down into the receiving opening and the two flat slotting members will follow the upper base to slant down. During the first part of the stapling process, the front single staple in the magazine is driven by the plunger blade into the sheets of paper fully while the top surfaces of the two flat slotting members form a substantial V-shaped plane at the beginning of the process. During the second part of the stapling process, the two flat slotting members are pushed by the lower clincher member and the top surfaces of the two flat slotting members form a substantially horizontal plane and eventually bend over ends of the staple and flatten the ends making them fold up tight against the sheets of paper. Therefore, the user can fasten the sheets of paper together with flat clinches.

When the staples in the magazine are all used up, the user can simply replace new staples into the magazine by pressing the push button. Once the push button is pushed forward, the second hooked arms are thereby driven to disengage from the first hooked arms, and the front end of the magazine then protrudes outward. The user can then lift up the protection cover to pull out the staple holder and place new staples in the magazine without spending effort on separating the magazine from the metal head with his fingers. After placing new staples, the user can simply lift up the protection cover and push the staple holder backward, the first hooked arms of the staple holder will then engage with the second hooked arms of and the magazine is therefore locked and secured.

In comparison with the prior art, the present invention has the following advantages and effects:

Firstly, the present invention requires less exertion effort than a conventional stapler. In a conventional stapler, the fulcrum is the pin that connects the metal head and the pressing cap at the rear end. In the present invention, the interaction of the arm and the metal head results in savings in the exertion effort.

Secondly, as the sliding belt manufactured by plastics or leather is used to synchronize the movement of the pressing cap and the blocking member instead of metallic materials used in the conventional staplers, the present invention is susceptible of a lower cost of manufacture and lighter in weight.

Thirdly, the present invention has a protection cover which can prevent fingers or other things from inserting into the space for the purposes of safety.

Fourthly, the present invention has a push button which functions to release the magazine for placing a row of new staples. Therefore, user no longer has to separate the magazine from the metal head with effort and refilling new staples become convenient and effortless.

DETAILED DESCRIPTION OF THE INVENTION

The preferred embodiment of the present invention is further described in detail with the following embodiment and the accompanying drawings.

Figure 1:
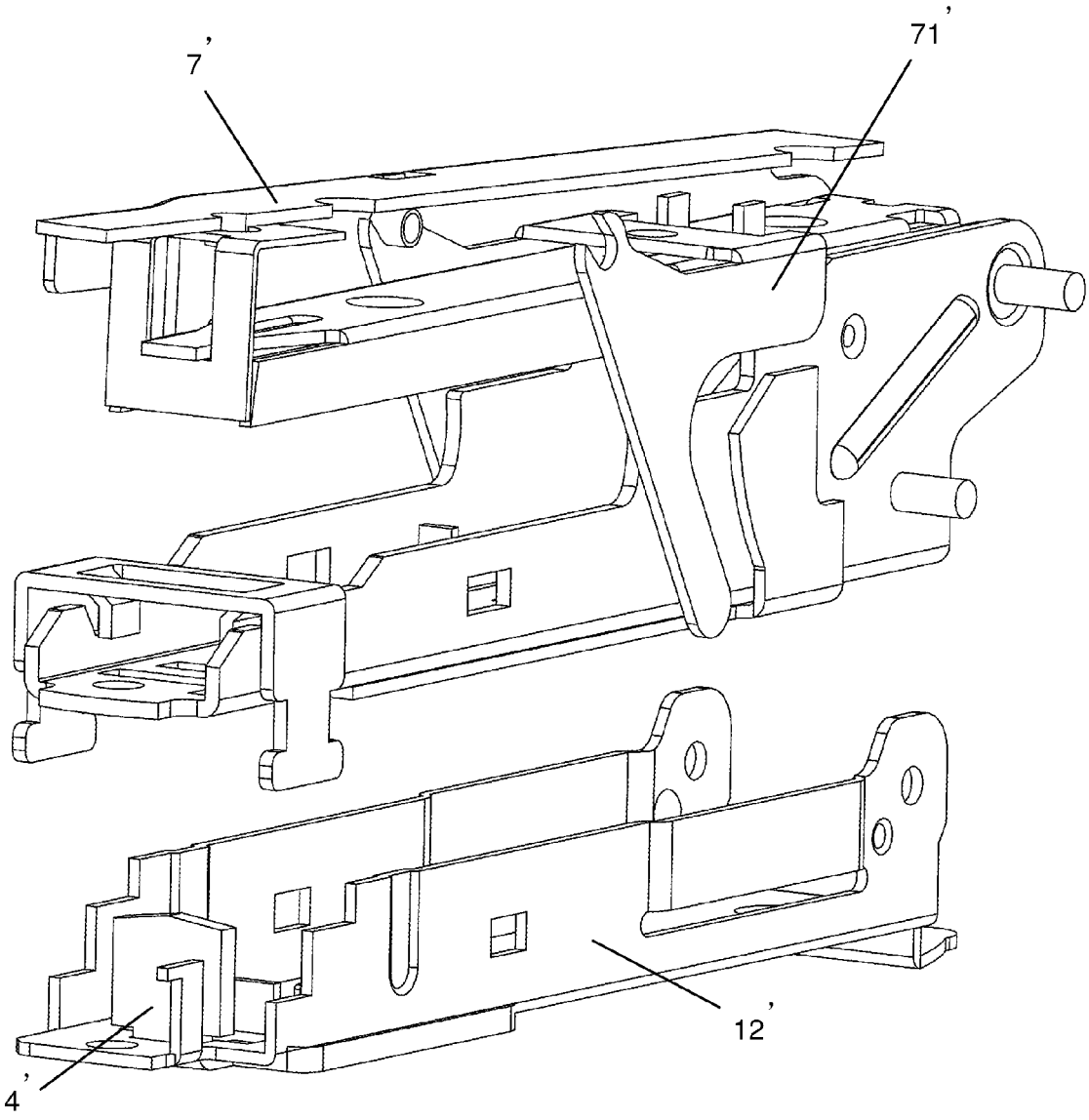
FIG. 1 PRIOR ART
FIG. 1 is a partial exploded view of a conventional flat-clinch stapler.
Figure 2:
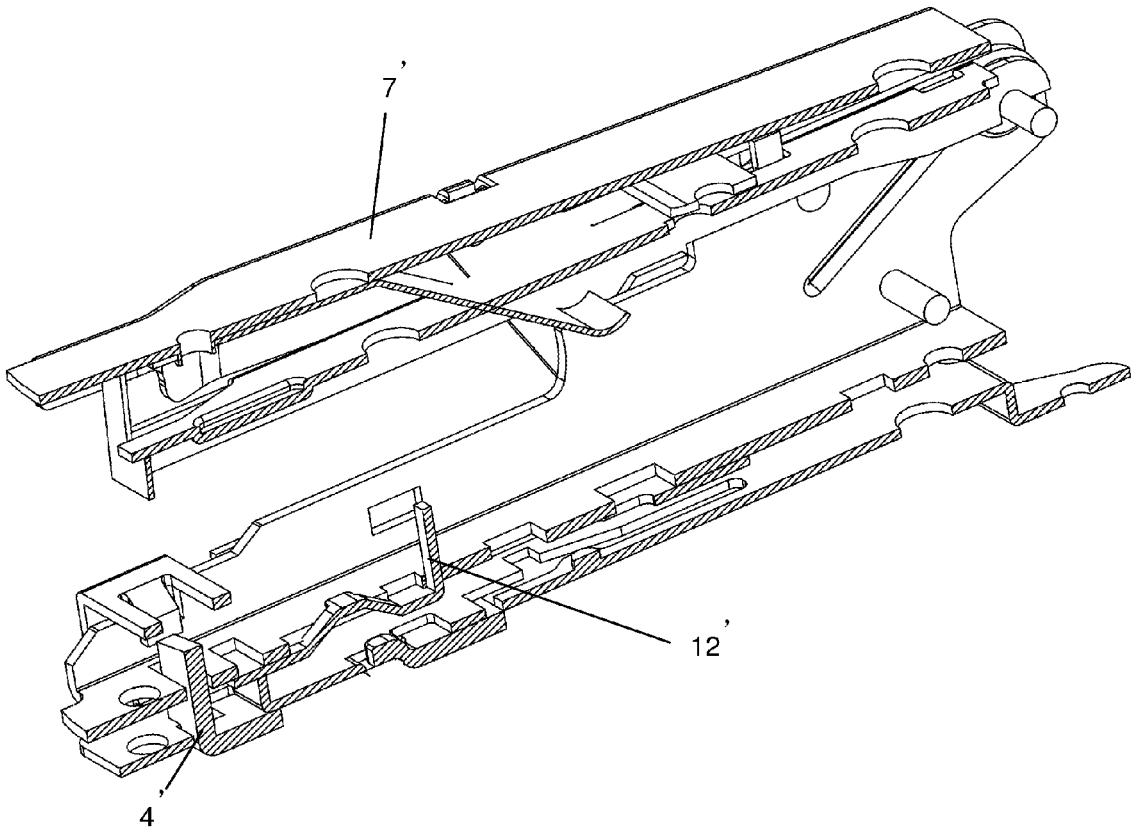
FIG. 2 PRIOR ART
FIG. 2 is a partial perspective view of a convention flat-clinch stapler at a non-stapling default position.
Figure 3:
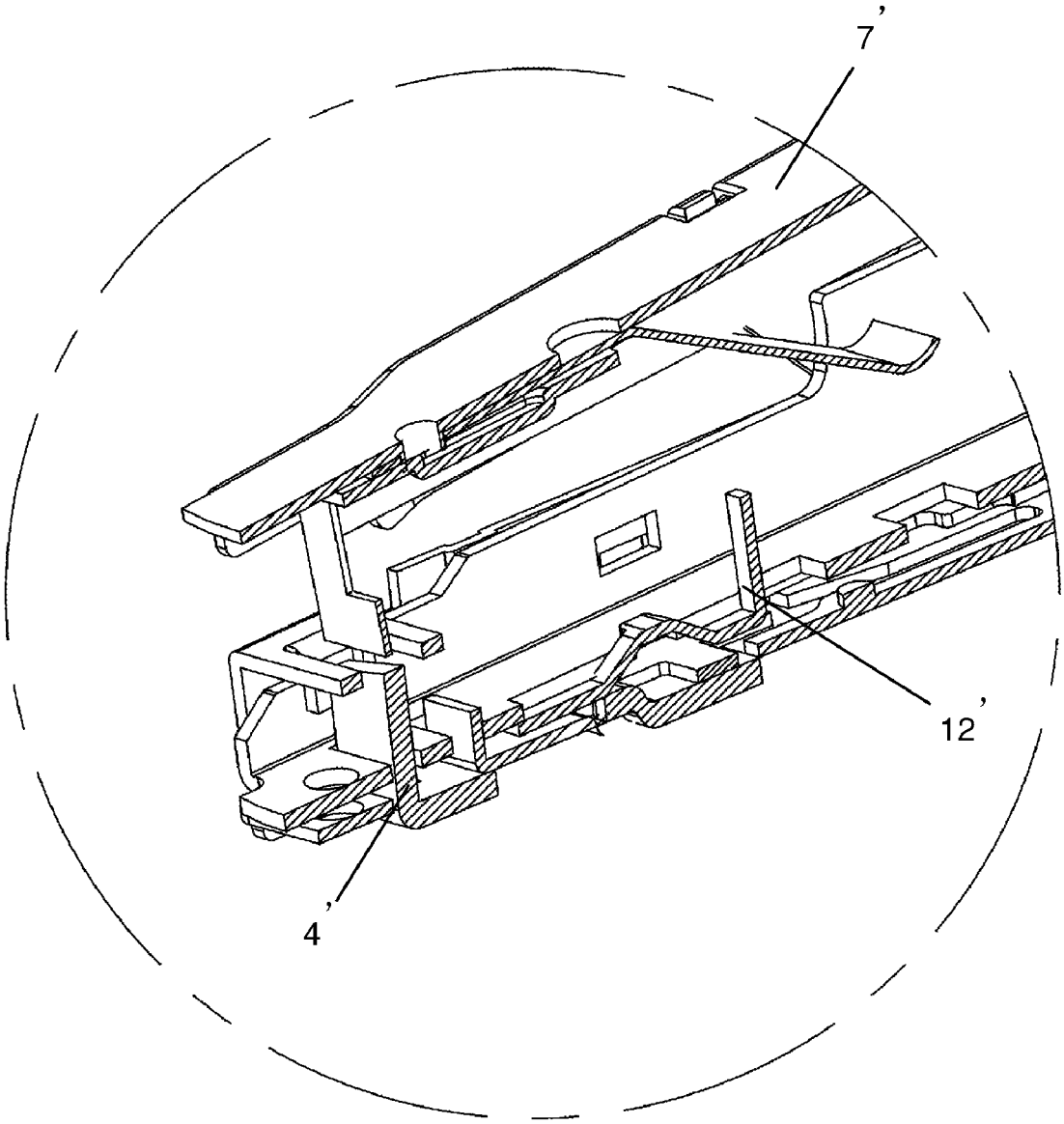
FIG. 3 PRIOR ART
FIG. 3 is a partial perspective view of a conventional flat-clinch stapler at a stapling position.
Figure 4:
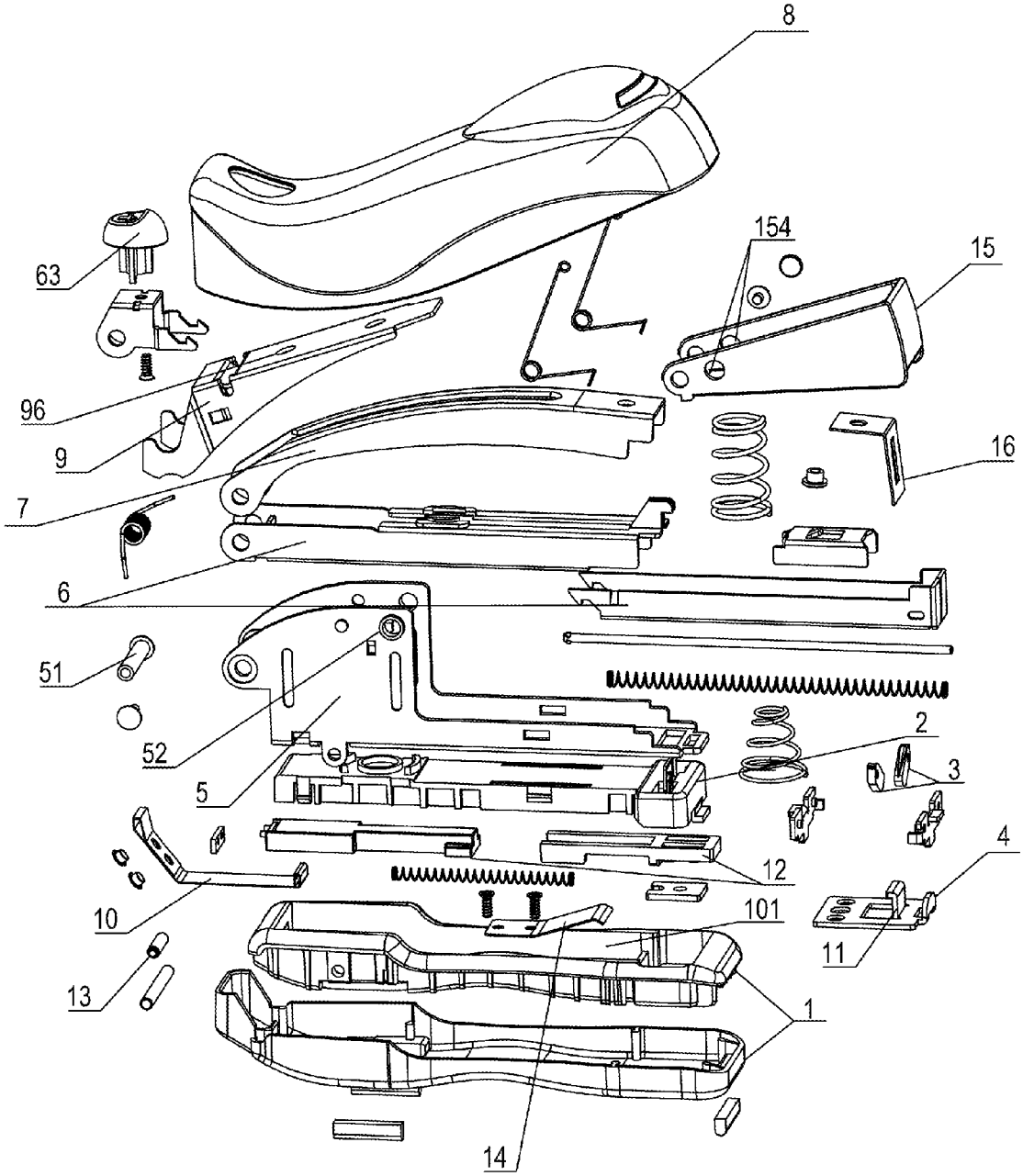
FIG. 4 is an exploded view of a preferred embodiment of the present invention.
Figure 5:
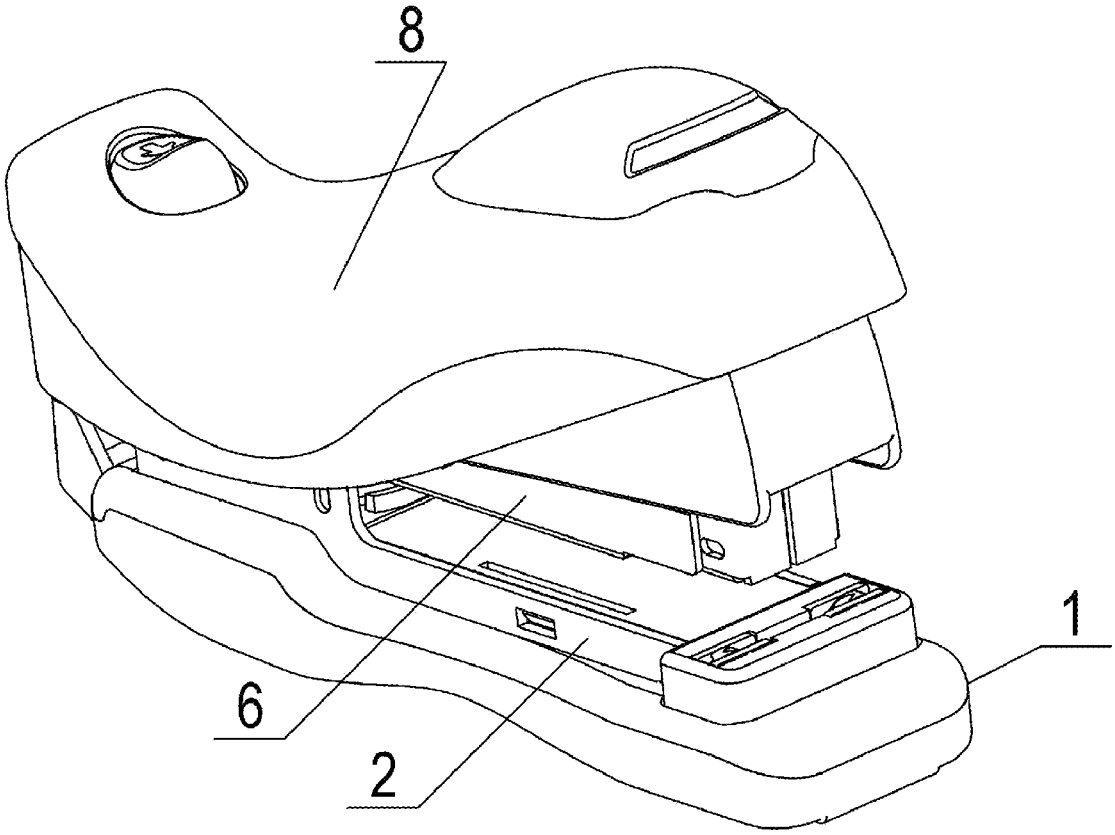
FIG. 5 is a perspective view of the preferred embodiment of the present invention.

As illustrated in FIGS. 4 to 5, the present invention comprises a lower base 1, an upper base 2, an upper clincher member 3, a lower clincher member 4, a hanger 5, a magazine 6, a metal head 7 and a pressing cap 8. The lower base 1 is disposed with a receiving opening 101. The upper base 2 slants down into the receiving opening 101 at a stapling position. The upper clincher member 3 is disposed at a front end of the upper base 2. The lower clincher member 4 is fixedly disposed inside the receiving opening 101 which achieves clinching effect when engaging with the upper clincher member 3. In this embodiment, the lower clincher member 4 is in the form of a vertical plate. The hanger 5 is welded to the upper base 2 and disposed with a pin 51. The magazine 6 has a rear end which is pivotable around the pin 51 of the hanger 5. The metal head 7 covers the magazine 6 and has a rear end pivotable around the pin 51 of the hanger 5. The pressing cap 8 covers the metal head 7.

Figure 6:
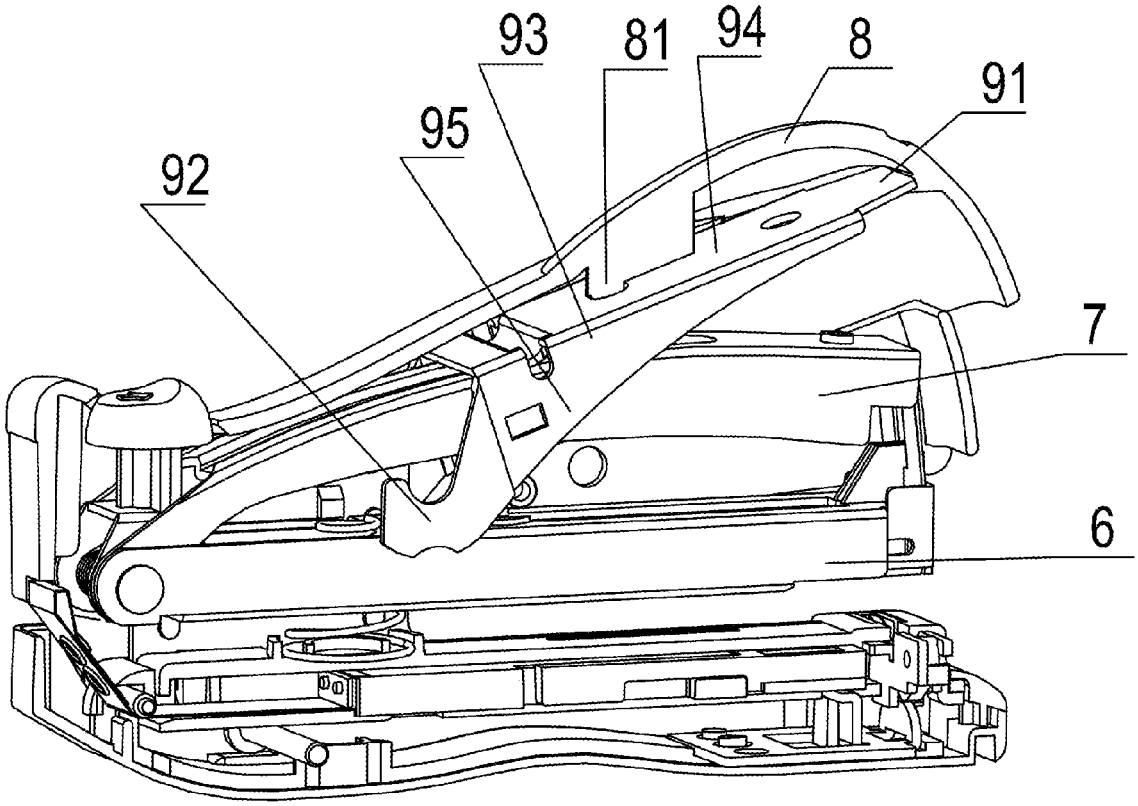
FIG. 6 is a partial perspective view illustrating the arm of the preferred embodiment of the present invention.
Figure 7:
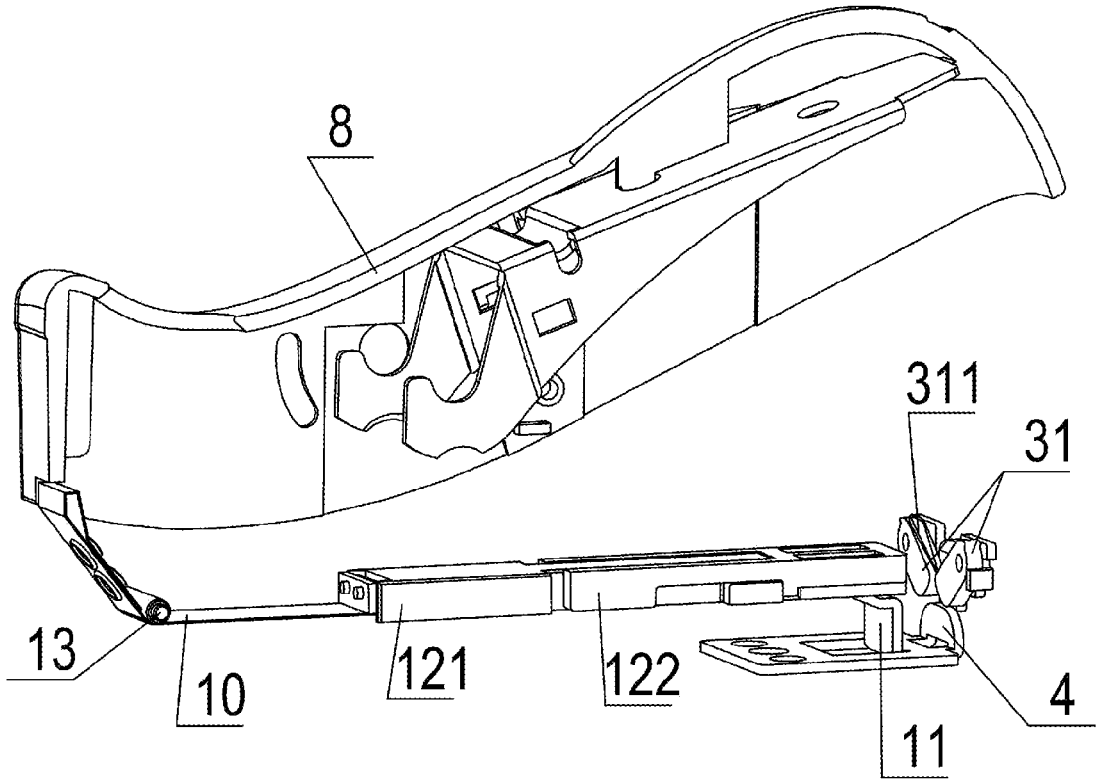
FIG. 7 is a partial perspective view illustrating the sliding belt and the blocking member of the preferred embodiment of the present invention at a non-stapling default position.
Figure 8:
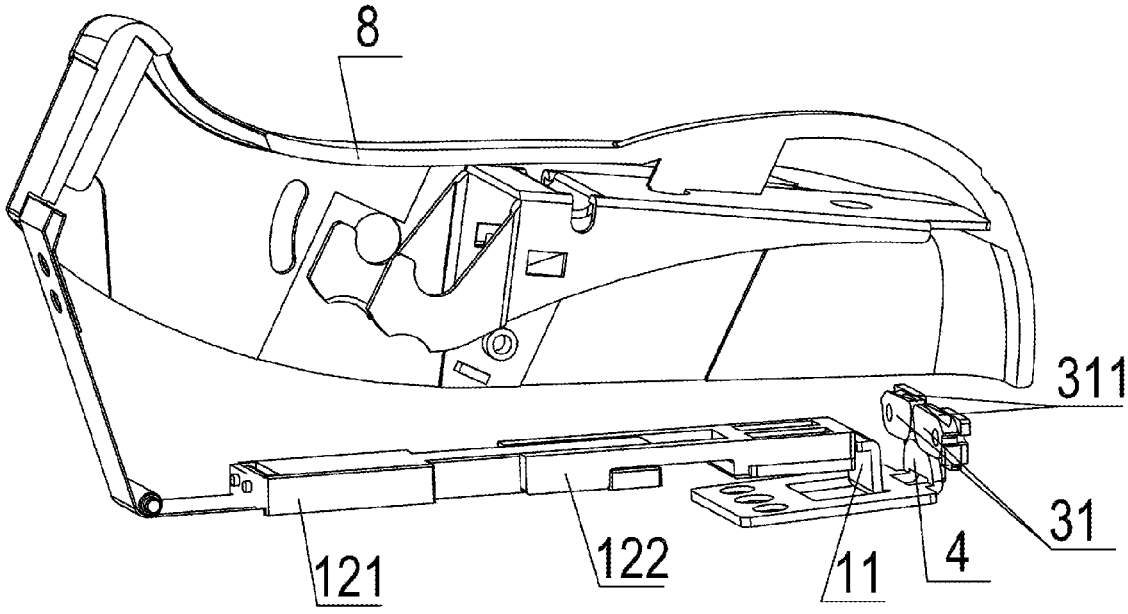
FIG. 8 is a partial perspective view illustrating the sliding belt and the blocking member of the preferred embodiment of the present invention at a stapling position.
Figure 9:
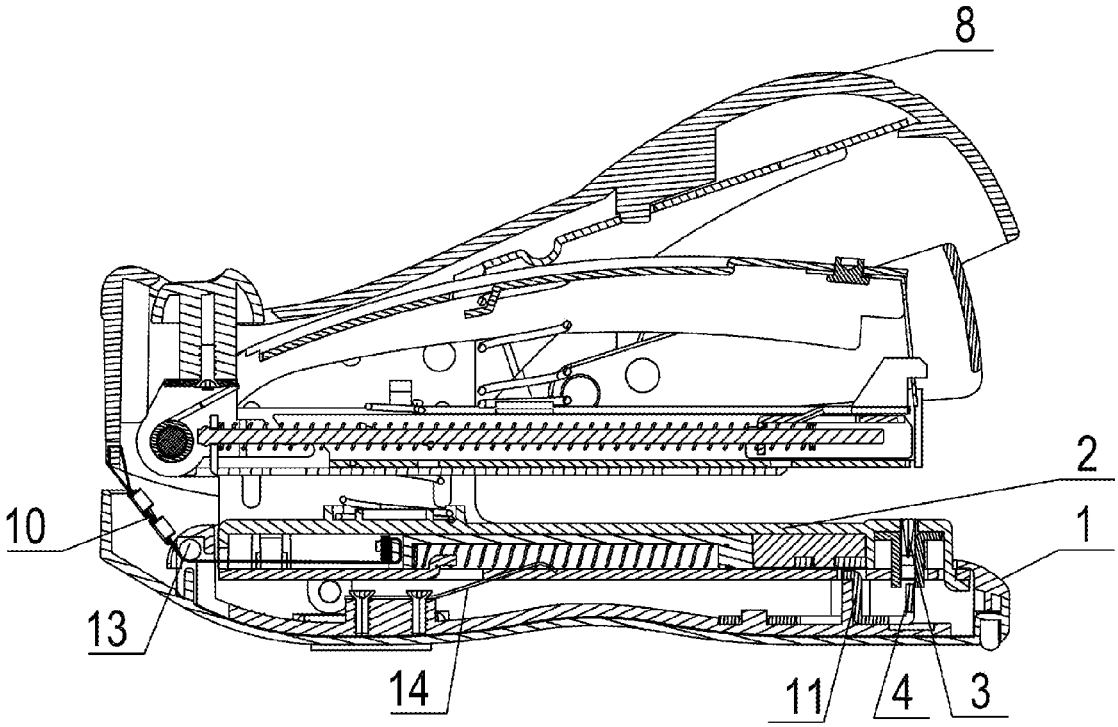
FIG. 9 is a cross-sectional view of the preferred embodiment of the present invention at a non-stapling default position.
Figure 10:
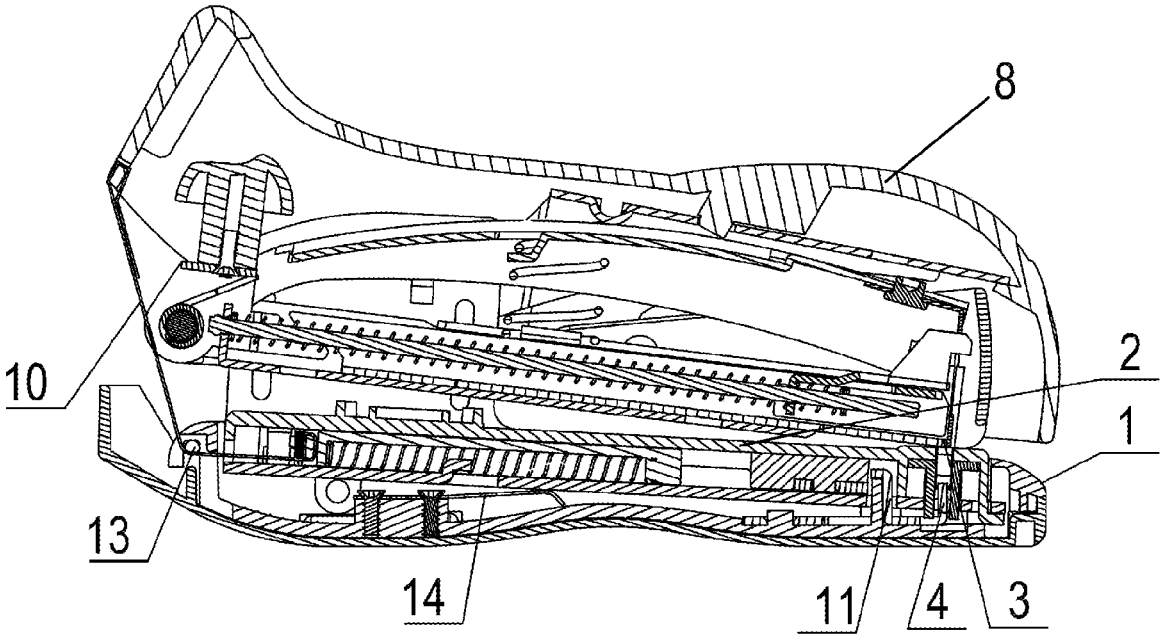
FIG. 10 is a cross-sectional view of the preferred embodiment of the present invention at a stapling position.

As illustrated in FIGS. 4 and 6, the present invention further comprises an arm 9. The arm 9 is disposed in between the pressing cap 8 and the metal head 7 with a length shorter than that of the metal head 7. The arm 9 comprises a front end 91 which is securely connected to an anterior portion inside the pressing cap 8 and acts as an effort, a rear end 92 which is pivotable around an axis at a position between the metal head 7 and the magazine 6 and acts as a fulcrum, and a load portion 93 in between the front end 91 and the rear end 92 of the arm 9 which is securely connected to the pressing cap 8. In this embodiment, the arm 9 is in the form of an elongated cover which partially covers the metal head 7 and comprises a top plane 94 and two lateral walls 95 extended down from a left side and a right side of the top plane 94, and a hole 96 is opened at the top plane 94 for receiving a pressing block 81 extended from the pressing cap 8, and the two lateral walls 95 at the rear end of the arm 9 is designed to rotate around two corresponding protrusions 52 each being disposed on two external sides of the hanger 5.

As illustrated in FIGS. 4, 7 to 10, the present invention further comprises a sliding belt 10, a stopper 11 and a blocking member 12. The sliding belt 10 has a rear end connected to a rear end of the pressing cap 8. In this embodiment, the sliding belt 10 is a plastic band. In other embodiments, the sliding belt 10 can be a leather strap. The sliding belt 10 is engaged with a pulley 13 disposed at the rear end of the lower base 1 for ease of sliding of the sliding belt 10. The stopper 11 is disposed inside the receiving opening 101. The blocking member 12 is disposed inside the receiving opening 101 of the lower base 1 and is biased by a spring piece 14 disposed underneath the blocking member 12 inside the lower base 1 to be disposed above the stopper 11 at the non-stapling default position. In this embodiment, the blocking member 12 comprises a first blocking piece 121 and a second blocking piece 122 which are slidably engaged with each other. A rear end of the first blocking piece 121 is connected to a front end of the sliding belt 10. At the non-stapling default position a front end of the first blocking piece 121 is disposed to push the second blocking piece 122 forward so as to maintain a front end of the second blocking piece 122 at a position above the stopper 11 and thereby blocks the upper clincher member 3 from engaging with the lower clincher member 4. At the stapling position the rear end of the sliding belt 10 is pulled upward by upward movement of the rear end of the pressing cap 8, thereby pulling the front end of the first blocking piece 121 rearward and pulling the second blocking piece 122 backward and away from the stopper 11, and thus allowing the upper base 2 to slant down into the receiving opening 101 and the upper clincher member 3 to engage with the lower clincher member 4.

In this embodiment, the upper clincher member 3 comprises two pivotable flat slotting members 31 disposed above the lower clincher member 4, and each of the flat slotting members 31 has a top surface 311. At a stapling position the top surfaces 311 of the two flat slotting members 31 are pushed by the lower clincher member 4 to form a substantially horizontal plane to bend over ends of a staple and flatten the ends making them fold up tight against sheets of paper. At a non-stapling default position the top surfaces 311 of the two flat slotting members 31 form a substantial V-shaped plane.

Figure 11:
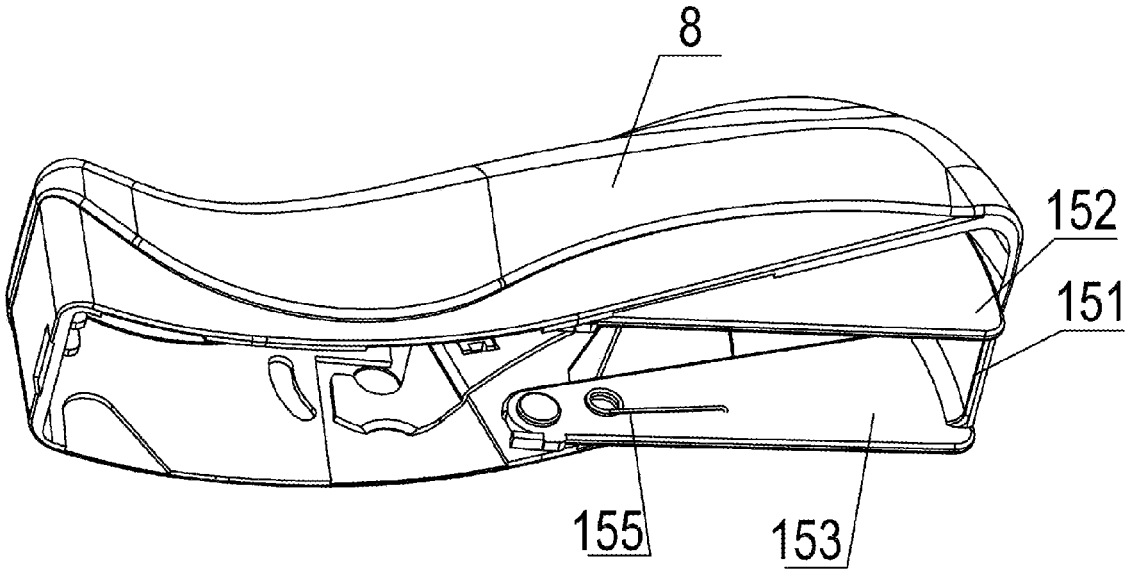
FIG. 11 is a partial perspective view of the preferred embodiment of the present invention illustrating the protection cover.

As illustrated by FIGS. 4 and 11, the present invention further comprises a protection cover 15 which is disposed to conceal the space in between the metal head 7 and the magazine 6. The protection cover 15 comprises a front side 151, a left side 152 and a right side 153. The left side 152 and the right side 153 of the protection cover 15 is each pivotally connected to an internal surface of the pressing cap 8 at a position at a rear end of the protection cover 15. The left side 152 and the right side 153 of the protection cover 15 each further comprises a hole 154 opened at the rear end, and each of the two holes 154 engages with a coil spring 155 and one end of each coil spring 155 is hooked onto the internal surface of the protection cover 15 and the other end of each coil spring 155 is hooked onto the internal surface of the pressing cap 8.

Figure 12:
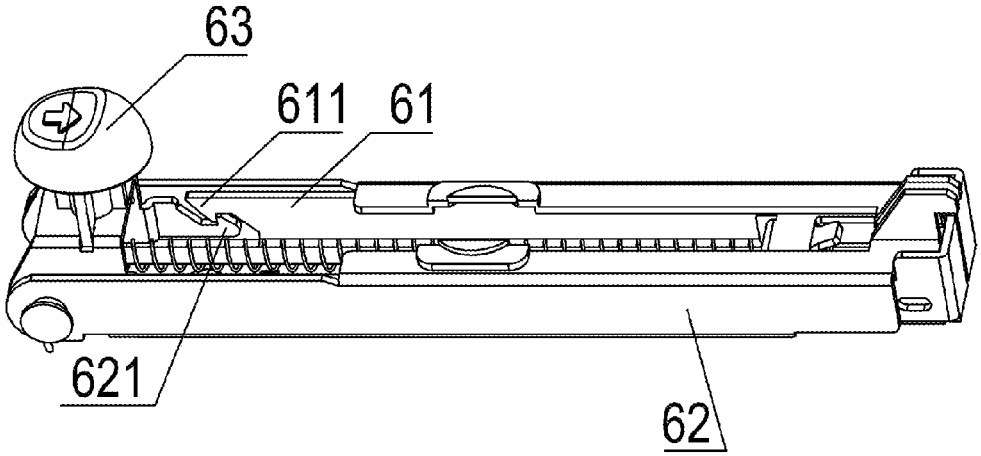
FIG. 12 is a partial perspective view of the preferred embodiment of the present invention illustrating the magazine at a closed default position.
Figure 13:
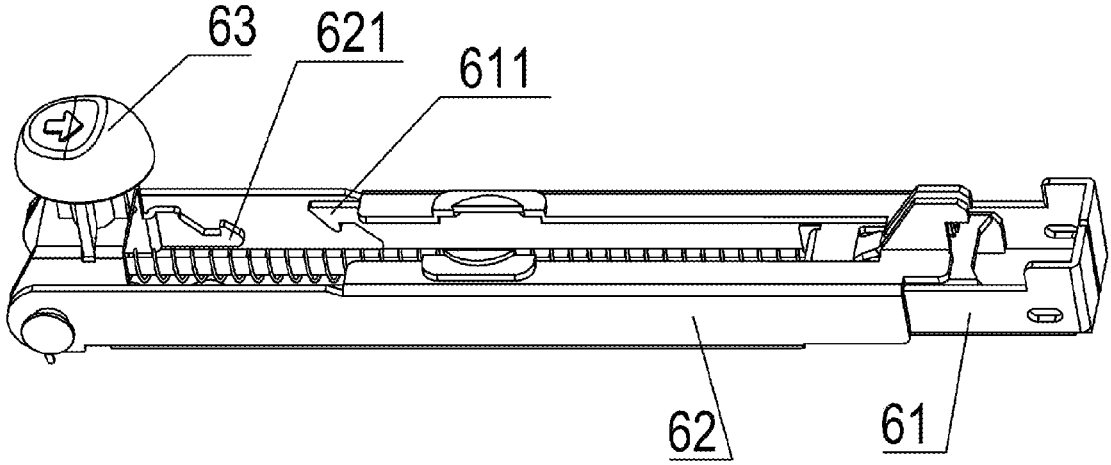
FIG. 13 is a partial perspective view of the preferred embodiment of the present invention illustrating the magazine at an opened position.

As illustrated by FIGS. 12 and 13, in this embodiment, the magazine 6 comprises a staple holder 61 and a magazine cover 62 which are slidably engaged with each other. Two lateral sides of the staple holder 61 each has a first hooked arm 611 at its rear end, and two lateral sides of the magazine cover 62 each is disposed with a second hooked arm 621 which is releasably engaged with the corresponding first hooked arm 611. A push button 63 is disposed outside the pressing cap 8 with its bottom end connected to the second hooked arms 621 and engaging the second hooked arms 621 with the first hooked arms 611 at a closed default position. At an opened position the push button 63 is pushed and thereby driving the second hooked arms 621 to disengage from the first hooked arms 611.

To use the present invention, the user inserts the sheets of paper to be stapled from the stapling end and then presses the front part of the pressing cap 8. The front end of the arm 9 is pressed down, the rear end of the arm 9 acts as a fulcrum and pivots around the protrusions 52 disposed on two external sides of the hanger 5, and the pressing block 81 presses the metal head 7 to drive down the plunger blade 16 to separate the front single staple from the row of staples. The protection cover 15 also gradually retreats into the pressing cap 8. Simultaneously, when the front part of the pressing cap 8 is pressed, the back end of the pressing cap 8 is raised pulling the sliding belt 10 upward and thus pulling the first blocking piece 121 and the second blocking piece 122 backward and away from the stopper 11. During the stapling process, the upper base 2 will gradually slant down into the receiving opening 101 and the two flat slotting members 31 will follow the upper base 2 to slant down. During the first part of the stapling process, the front single staple in the magazine 6 is driven by the plunger blade 16 into the sheets of paper fully while the top surfaces 311 of the two flat slotting members 31 form a substantial V-shaped plane at the beginning of the process. During the second part of the stapling process, the two flat slotting members 31 are pushed by the lower clincher member 4 and the top surfaces 311 of the two flat slotting members 31 form a substantially horizontal plane and eventually bend over ends of the staple and flatten the ends making them fold up tight against the sheets of paper. Therefore, the user can fasten the sheets of paper together with flat clinches.

When the staples in the magazine 6 are all used up, the user can simply replace new staples into the magazine 6 by pressing the push button 63. Once the push button 63 is pushed forward, the second hooked arms 621 are thereby driven to disengage from the first hooked arms 611, and the front end of the magazine 6 then protrudes outward. The user can then lift up the protection cover 15 to pull out the staple holder 61 and place new staples in the magazine 6 without spending effort on separating the magazine 6 from the metal head 7 with his fingers. After placing new staples, the user can simply lift up the protection cover 15 and push the staple holder 61 backward, the first hooked arms 611 of the staple holder 61 will then engage with the second hooked arms 621 of and the magazine 6 is therefore locked and secured.

Figure 14:
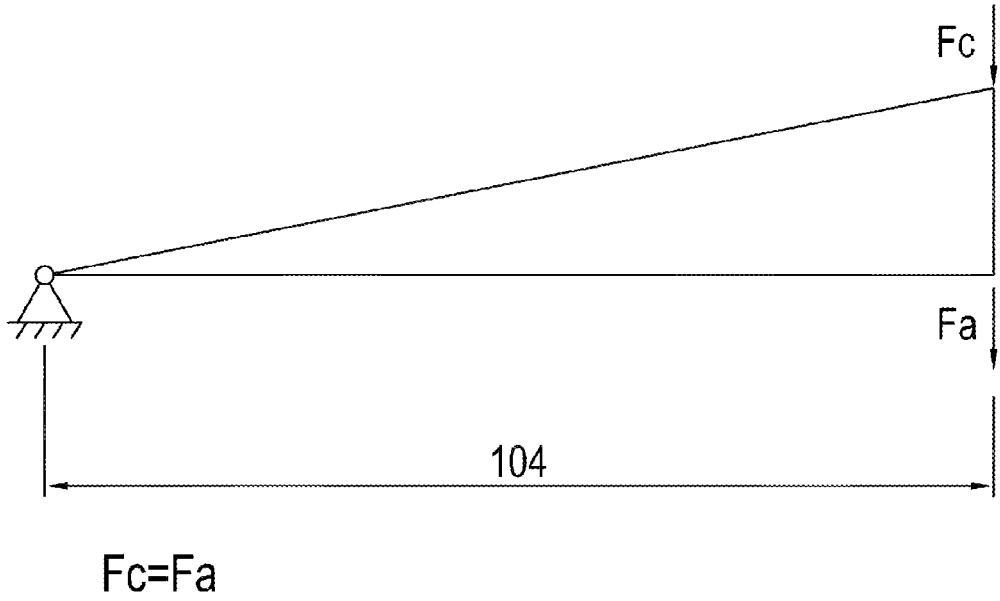
FIG. 14 is a diagram illustrating the exertion effort required by a conventional stapler.
Figure 15:
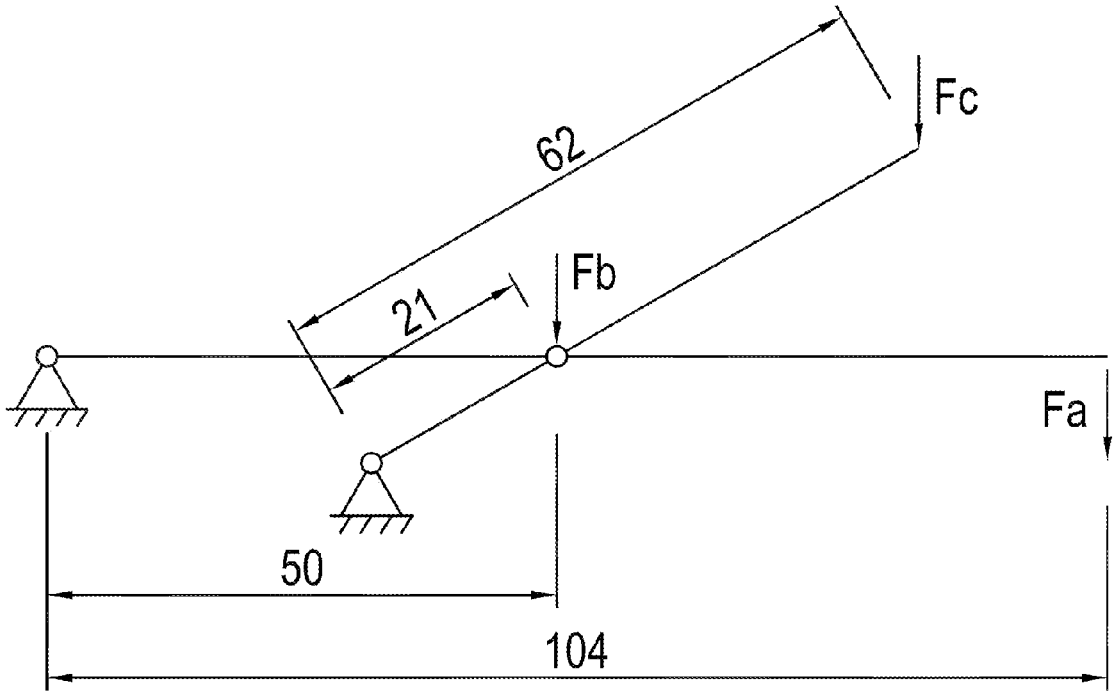
FIG. 15 is a diagram illustrating the exertion effort required by the preferred embodiment of the present invention.

The present invention makes use of the mechanism of the arm to allow for savings in exertion effort and the use of the sliding belt mechanism to achieve the clinching effect. According to the Law of Lever, the distance from the fulcrum to the load ("the load distance") multiplies by the load force is equal to the distance from the fulcrum to the effort ("the effort distance") multiplies by the effort force. Assuming that the load force is constant, increasing the ratio of the load distance to the effort distance should increase the effort force, and decreasing the ratio of the load distance to the effort distance should decrease the effort force. As illustrated in FIG. 14, the load force Fa is substantially equal to the effort force Fc as both the load and the effort are at the front end of the metal head. FIG. 15 illustrates the load distances and effort distances of the preferred embodiment of the present invention in millimeter. As illustrated in FIG. 15, although the present invention moves the effort from the front end of the metal head to the middle portion of the metal head which presumably should increase the effort force Fb required to drive the plunger blade to move downward, the effort force Fb is substantially reduced by making use of the arm. The load force of the arm translate into the effort force required to drive the plunger blade to move downward, and by reducing the load distance relative to the effort distance, the effort force Fc required to drive the front end of the arm to move downward and thereby moving the metal head downward is substantially reduced. In other words, by arranging the configuration of the arm so that the ratio of the load distance of the arm to the effort distance of the arm is smaller than the ratio of the load distance of the metal head to the effort distance of the metal head, savings in exertion effort relative to conventional staplers can be achieved. Furthermore, the arm mechanism allows the rear end of the metal head to raise higher, thereby allowing for the use of the sliding belt to cooperate with the blocking member, thus replacing the metal components for conventional flat-clinch staplers which are more expensive.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A hand-operated stapler comprising a lower base disposed with a receiving opening;

an upper base which slants down into the receiving opening at a stapling position;

an upper clincher member disposed at a front end of the upper base;

a lower clincher member fixedly disposed inside the receiving opening which achieves clinching effect when engaging with the upper clincher member;

a hanger welded to the upper base and disposed with a pin;

a magazine with its rear end pivotable around the pin of the hanger;

a metal head which covers the magazine and having its rear end pivotable around the pin of the hanger;

a pressing cap which covers the metal head;

an arm disposed in between the pressing cap and the metal head with a length shorter than that of the metal head, wherein the arm comprises a front end which is securely connected to an anterior portion inside the pressing cap and acts as an effort; a rear end which is pivotable around an axis at a position between the metal head and the magazine and acts as a fulcrum; and a load portion in between the front end and the rear end of the arm which is securely connected to the pressing cap and drives the metal head to move downward at the stapling position;

a sliding belt with its rear end connected to a rear end of the pressing cap;

a stopper disposed inside the receiving opening; and a blocking member disposed inside the receiving opening of the lower base, wherein a rear end of the blocking member is connected to a front end of the sliding belt, and at a non-stapling default position a front end of the blocking member is biased to be disposed above the stopper and thereby blocks the upper clincher member from engaging with the lower clincher member; and at a stapling position the rear end of the sliding belt is pulled upward by upward movement of the rear end of the pressing cap, thereby pulling the blocking member rearward and away from the stopper and thus allowing the upper base to slant down into the receiving opening and the upper clincher member to engage with the lower clincher member.

2. The hand-operated stapler as in claim 1, wherein the sliding belt can be a plastic band or a leather strap.

3. The hand-operated stapler as in claim 1, wherein the lower base further comprises a pulley disposed at its rear end, and the pulley is engaged with the sliding belt for ease of sliding of the sliding belt.

4. The hand-operated stapler as in claim 1, wherein the blocking member is biased by a spring piece disposed underneath the blocking member inside the lower base to be disposed above the stopper at the non-stapling default position.

5. The hand-operated stapler as in claim 1, wherein the blocking member comprises a first blocking piece and a second blocking piece which are slidably engaged with each other, and a rear end of the first blocking piece is connected to a front end of the sliding belt, and at the non-stapling default position a front end of the first blocking piece is disposed to push the second blocking piece forward so as to maintain a front end of the second blocking piece at a position above the stopper, and at the stapling position the front end of the first blocking piece is disposed to pull the second blocking piece backward and away from the stopper.

6. The hand-operated stapler as in claim 1, wherein the lower clincher member is in the form of a vertical plate.

7. The hand-operated stapler as in claim 1, wherein the upper clincher member comprises two pivotable flat slotting members disposed above the lower clincher member, and each of the flat slotting members has a top surface, and at a stapling position the top surfaces of the two flat slotting members are pushed by the lower clincher member to form a substantially horizontal plane to bend over ends of a staple and flatten the ends making them fold up tight against sheets of paper, and at a non-stapling default position the top surfaces of the two flat slotting members form a substantial V-shaped plane.

8. The hand-operated stapler as in claim 1, wherein the arm is in the form of an elongated cover which partially covers the metal head and comprises a top plane and two lateral walls extended down from a left side and a right side of the top plane, and a hole is opened at the top plane for receiving a pressing block extended from the pressing cap, and the two lateral walls at the rear end of the arm is designed to rotate around two corresponding protrusions each being disposed on two external sides of the hanger.

9. The hand-operated stapler as in claim 1, wherein the ratio of an arm load distance to an arm effort distance is smaller than the ratio of a metal head load distance to a metal head effort distance; wherein the arm load distance is the distance between the fulcrum of the arm and the load portion of the arm; the arm effort distance is the distance between the fulcrum of the arm and the effort of the arm; the metal head load distance is the distance between the pin of the hanger and a front end of the metal head; and the metal head effort distance is the distance between the pin of the hanger and the load portion of the arm at the stapling position.

10. The hand-operated stapler as in claim 1, wherein a protection cover is disposed to conceal the space in between the metal head and the magazine; the protection cover comprises a front side, a left side and a right side; and the left side and the right side of the protection cover are each pivotally connected to an internal surface of the pressing cap at a position at a rear end of the protection cover.

11. The hand-operated stapler as in claim 10, wherein the left side and the right side of the protection cover each further comprises a hole opened at the rear end, and each of the two holes engages with a coil spring and one end of each coil spring is hooked onto an internal surface of the protection cover and the other end of each coil spring is hooked onto the internal surface of the pressing cap.

12. The hand-operated stapler as in claim 1, wherein the magazine comprises a staple holder and a magazine cover which are slidably engaged with each other, and two lateral sides of the staple holder each has a first hooked arm at its rear end, and two lateral sides of the magazine cover each is disposed with a second hooked arm which is releasably engaged with the corresponding first hooked arm, and a push button is disposed outside the pressing cap with its bottom end connected to the second hooked arms and engaging the second hooked arms with the first hooked arms at a closed default position, and at an opened position the push button is pushed and thereby driving the second hooked arms to disengage from the first hooked arms.

* * * * *